US009534624B2

(12) United States Patent
Rautionmaa

(10) Patent No.: US 9,534,624 B2
(45) Date of Patent: Jan. 3, 2017

(54) ADAPTER

(71) Applicant: R 'N D UNIVERSAL OY, Pirkkala (FI)

(72) Inventor: Niilo Rautionmaa, Pirkkala (FI)

(73) Assignee: R 'N D Universal Oy, Pirkkala (FI)

( * ) Notice: Subject to any disclaimer, the term of this patent is extended or adjusted under 35 U.S.C. 154(b) by 6 days.

(21) Appl. No.: 14/429,764

(22) PCT Filed: Sep. 20, 2013

(86) PCT No.: PCT/FI2013/050907
§ 371 (c)(1),
(2) Date: Mar. 19, 2015

(87) PCT Pub. No.: WO2014/044914
PCT Pub. Date: Mar. 27, 2014

(65) Prior Publication Data

US 2015/0219135 A1 Aug. 6, 2015

(30) Foreign Application Priority Data

Sep. 20, 2012 (FI) ..... 20125972

(51) Int. Cl.
*F16B 23/00* (2006.01)
*F16B 17/00* (2006.01)
*E02F 3/36* (2006.01)

(52) U.S. Cl.
CPC ..... *F16B 17/00* (2013.01); *E02F 3/3613* (2013.01); *E02F 3/3636* (2013.01); *E02F 3/3686* (2013.01)

(58) Field of Classification Search
CPC ..... F16B 5/0283; F16B 17/00; F16B 23/00; F16B 35/06; E02F 3/3613; E02F 3/3636; E02F 3/3686
USPC ..... 411/383, 396, 398, 432, 546
See application file for complete search history.

(56) References Cited

U.S. PATENT DOCUMENTS 1,044,055 A * 11/1912 Johnson et al. .... E05D 11/1078 16/242
2,859,058 A * 11/1958 Traugott ..... B62D 17/00 280/93.508
3,124,370 A * 3/1964 Traugott ..... B60G 7/02 280/86.756
3,408,924 A * 11/1968 Mueller ..... B21D 37/04 100/295
3,747,168 A * 7/1973 Snarskis ..... F16B 5/025 411/349
4,106,876 A * 8/1978 Tregoning ..... E05D 15/0634 16/105
4,813,163 A 3/1989 Livingston et al.
6,662,681 B2 * 12/2003 Crane ..... E02F 3/3613 248/200

(Continued)

FOREIGN PATENT DOCUMENTS

DE 102010018155 A1 11/2010
WO 03069077 A1 8/2003

*Primary Examiner* — Roberta Delisle
(74) *Attorney, Agent, or Firm* — Ziegler IP Law Group, LLC

(57) ABSTRACT

An adapter for mounting an implement to a working arm of a working machine includes an acentric hole for an implement attachment. The adapter comprises a base element having one or more movement restricting formations, a shaft having a threading, and a nut for tightening the adapter to the implement attachment.

11 Claims, 4 Drawing Sheets

(56) References Cited

U.S. PATENT DOCUMENTS

| | | | | |
|---|---|---|---|---|
| 6,938,514 | B1 * | 9/2005 | Crane | E02F 3/3613 248/200 |
| 7,204,656 | B2 * | 4/2007 | Bjuhr | E02F 3/3636 403/4 |
| 8,696,283 | B1 * | 4/2014 | Dawson | F16B 35/04 411/383 |
| 8,915,688 | B2 * | 12/2014 | Dawson | F16B 35/04 411/383 |
| 2012/0227246 | A1 * | 9/2012 | Dawson | E02F 3/3636 29/525.08 |

* cited by examiner

ADAPTER

FIELD OF THE INVENTION

The present invention relates to an adapter for mounting an implement to a working arm of a working machine, the adapter comprising an acentric hole for an axis of an implement attachment and a base element having one or more movement restricting formations. The invention also relates to a method for fixing an implement by using an adapter comprising an acentric hole for an axis of an implement attachment and a base element having one or more movement restricting formations.

BACKGROUND OF THE INVENTION

Working machines are known in which it is possible to change a working tool to a working arm of the working machine. These kinds of changeable working tools may also be called as implements. Such implements may be coupled to the working arm e.g. by using an implement attachment. The working arm usually comprises two or more axes or other bar-like members (e.g. pins) which can be positioned through holes of two side walls of the implement attachment. One problem with such arrangements is that the holes in the implement attachment are fixed and only fit to working arms for which they have been designed. In other words, such implement attachments fit only such working arms in which the mutual distance between the axes correspond with the mutual distance between the holes in the implement attachment.

Some implement attachments are known in which an adapter may be put into the holes of the two side walls of implement adapter. The adapter comprises an eccentric hole for receiving the axis, wherein the distance between the acentric holes of the adapters may be slightly varied by rotating the adapters in the holes of the implement attachment. For example, the patent U.S. Pat. No. 7,204,656 discloses such arrangement for implement attachments. The arrangement comprises two or more adapters having acentric hole for receiving the axes of the working arm and threaded holes positioned in the circularly near an edge of a base element of the adapter. These threaded holes are for receiving tips of bolts for fixing the adapters to the walls of the implement attachment. Similar holes need also be formed to the walls of the implement attachment so that the bolts can be put through the holes of the walls of the implement attachment and screwed to the threaded holes of the adapter. Such a construction needs accurate machining (i.e. location of the holes in the walls of the of the implement attachment and the threaded holes of the adapters need to be accurately aligned). Furthermore, a relatively large number of bolts are need for fixing and thus there need to be a relatively large number of threaded holes in the adapters and holes in the walls of the implement attachment. Therefore, if the same implement attachment should be fixed to a different working arm in which the distance between the axes is different, at least one pair of the adapters need to be rotated into another position. This requires a lot of unscrewing and screwing work due to the high number of bolts.

WO03069077A1 discloses a connector assembly for attaching an implement to a prime mover having spaced connecting pins, the connector assembly including a pair of spaced plates, each of the plates carrying a first receiver to receive a first of the connecting pins and a second receiver adapted to receive the second of the connecting pins, wherein at least one of the first and second receivers is an adjustable receiver rotatable about an axis and having a transverse bore spaced radially from the axis and rotatable relative thereto, whereby rotation of the adaptable receiver about the axis changes the relative spacing.

The rotatable receiver may be positioned so that the distance between the connecting pins corresponds with the implement. Rotation of the rotatable receiver may be prevented by putting one or more lock pins into a receiver. Axial movement of the rotatable receiver may be prevented by providing a chamfered end at the end of the pin which may receive a lock ring and putting a washer between the lock ring and a side plate of the connector assembly.

This kind of construction has several drawbacks. For example, it may be difficult to remove the lock ring when the distance between the pins need to be changed. It may also be difficult to put the lock ring back when the receivers need to be secured in their place. Moreover, distance between the side plates of the connector assembly is not adjustable, wherein the connector assembly can only be used with implements in which the distance is appropriate.

SUMMARY OF THE INVENTION

An aim of the present invention is to provide an improved adapter for an implement attachment in which the above mentioned problems have been reduced or eliminated. The invention is based on the idea that the adapter comprises a base element having one or more movement restricting formations, and that the adapter is tightened with a nut or another corresponding element to an implement attachment. To put it more precisely, the adapter according to the present invention is mainly characterized in that the adapter comprises a shaft having a threading, a nut for tightening the adapter to the implement attachment. The method according to the present invention is mainly characterized in that the method comprises at least:

installing a shaft of the adapter through a hole in a wall of the implement attachment, said shaft having a threading;

adjusting the rotational position of the adapter with respect to the wall to set the acentric hole of the adapter to a desired location with respect to the hole in the wall of the implement attachment; locking the position of the adapter by one or more movement restricting formations of the adapter; and fixing the adapter to the wall by inserting a nut to the threading of the shaft.

The adapter according to the present invention provides more efficient and flexible solution for attaching implements to a working machine than the solutions of prior art. The adapter need not be machined so accurately than with prior art solutions. Furthermore, fixing and releasing the adapter is much faster and easier because the adapter itself is constructed in such a way that separate bolts are not needed. It may also be possible to modify an implement attachment in the field to adapt the implement attachment to be used with the adapter according to the present invention because no holes for fixing bolts need to be formed to the implement attachment but only the hole in which the adapter shall be installed suffices.

DESCRIPTION OF THE DRAWINGS

In the following the present invention will be described in more detail with reference to the appended drawings in which.

DETAILED DESCRIPTION OF THE INVENTION

In the following some examples of the adapter 1 according to the present invention are disclosed in more detail with reference to FIGS. 1*a*-1*f* and FIGS. 2*a*-2*k*. The adapter comprises a shaft 1*a* which is intended to be placed in the hole 2*b* of a wall 2*a* of an implement attachment 2. In this embodiment a first end of the shaft 1*a* of the adapter 1 has a base element 1*b*, which has a larger diameter than the shaft so that the base element 1*b* does not go through the hole of the wall 2*a* of the implement attachment. In other words, the diameter of the base element 1*b* is larger than the diameter of the hole 2*b*.

Figure 1A:
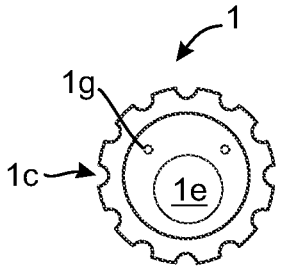
FIGS. 1*a*-1*f* depict some examples of the adapter according to an example embodiment of the present invention.
Figure 1B:
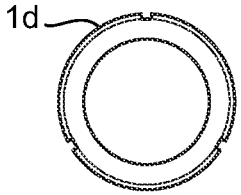
Figure 1C:
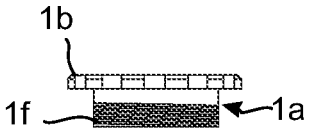
Figure 1D:
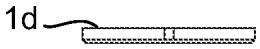
Figure 1E:
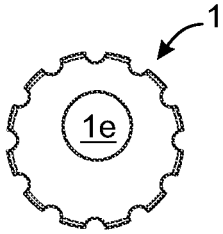
Figure 1F:
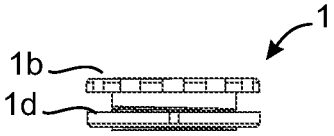

FIG. 1*a* depicts the shaft 1*a* and the base element 1*b* formed as one piece as a bottom view. In FIG. 1*c* the shaft 1*a* and the base element 1*b* as a side view, and FIG. 1*e* depicts the shaft 1*a* and the base element 1*b* as a top view. In FIG. 1*b* an example of a nut 1*d* is depicted as a top view and in FIG. 1*d* the nut 1*d* is depicted as a side view. FIG. 1*f* depicts as a side view the adapter 1 in which the nut 1*d* is partially screwed on the shaft 1*a*.

In this example the base element has one or more movement restricting formations 1*c*. In this example embodiments the movement restricting formations 1*c* are formed as notches at the outer circumference of the base element 1*b*. One purpose of the movement restricting formations 1*c* is to prevent or at least restrict the rotation of the adapter 1 in the hole 2*b* of the wall of the implement attachment 2. There are also other alternatives to implement the movement restricting formations 1*c*. For example, they can be formed as a protrusion on that surface of the base element 1*b* which is intended to be placed against the wall of the implement attachment 2. An example of this kind of arrangement is depicted in FIG. 1*c*. Still another example implementation of the movement restricting formations 1*c* is a hole through the base element 1*b* wherein a bolt can be screwed through the hole to the wall 2*a* of the implement attachment 2.

The base element 1*b* has an acentric hole 1*e*. Due to the acentric position of the hole 1*e* the adjustment of the distance of the axes 2*c* can be performed by rotating the base element 1*b*.

The shaft 1*a* of the adapter is hollow so that the axis 2*c* of the implement attachment can be placed through the hollow shaft 1*a* at least at the location of the hole of the base element. Therefore, the axis can be placed through the hollow shaft 1*a* and the hole of the base element.

In some embodiments the hole of the base element 1*b* need not be a through hole. However, the depth of the hole should be enough to receive the axis and provide enough support to the shaft to prevent the shaft dropping out from the hole.

The shaft 1*a* of the adapter has a threading 1*f* on the outer surface of the shaft, wherein the adapter 1 can be tightened by using a nut 1*d*.

Figure 3A:
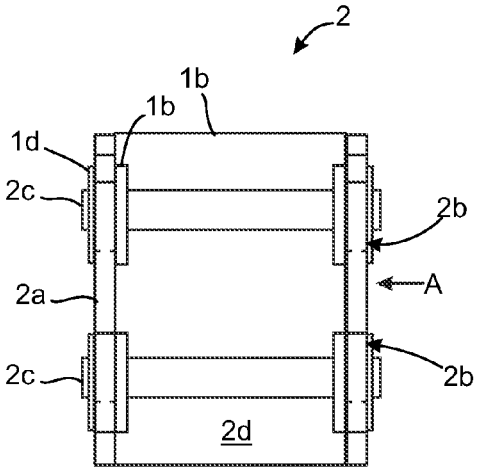
FIGS. 3*a*-3*d* depict an example of an implement attachment.
Figure 3B:
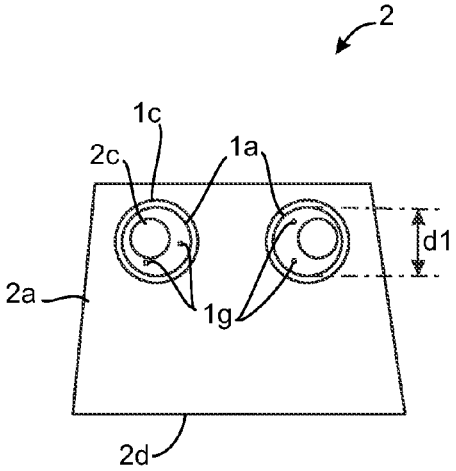
Figure 3C:
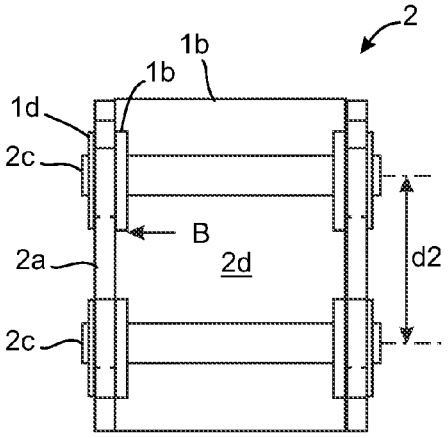
Figure 3D:
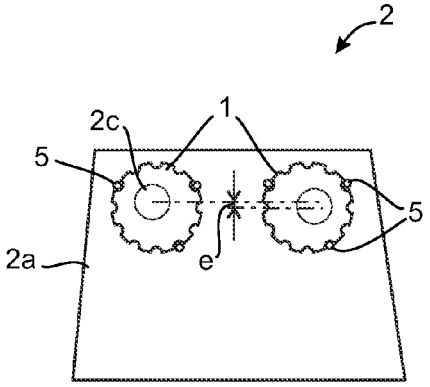
Figure 4:
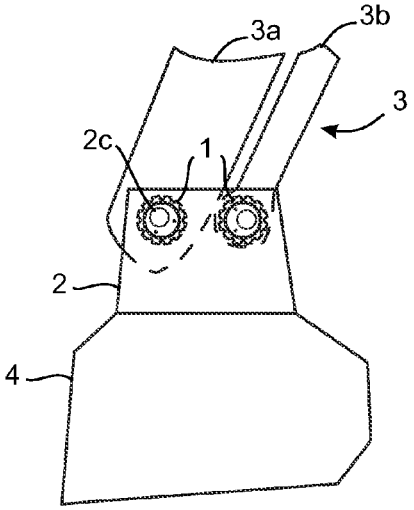
FIG. 4 depicts an example of a working arm in which the implement attachment has been fixed with the adapter according to an example embodiment of the present invention.

In the following the use of the adapter 1 for coupling the implement attachment 2 to a working arm 3 of a working machine is depicted in more detail with reference to FIGS. 3*a*-3*c* and 4. In this example FIGS. 3*a* and 3*c* illustrate the implement attachment 2 from above, FIG. 3*b* illustrates the implement attachment 2 in which the adapters 1 have been fixed as a side view from the right of FIG. 3*a* as depicted with the arrow A in FIG. 3*a*, and FIG. 3*d* illustrates the wall 2*a* of the implement attachment 2 in which the adapters 1 have been fixed as a side view from a viewpoint which is between the walls 2*a* of the implement attachment 2 as depicted with the arrow B in FIG. 3*c*. The implement attachment 2 comprises side walls 2*a* in which at least one hole 2*b* has been formed for receiving one or more axes 2*c* of the implement attachment 2. The diameter d1 of the holes 2*b* is larger than the outer diameter of the shaft 1*a* of the adapter 1 so that the shaft can be inserted through the hole of the wall 2*a*. The side walls of the implement attachment 2 are fixed to a bottom wall 2*d* of the implement attachment preferably in such a way that the side walls 2*a* are substantially parallel to each other. However, the walls need not be parallel to each other at all sections of the wall but it may be sufficient that those parts of the side walls are parallel in which the holes for the adapter are formed. The bottom wall 2*d* of the implement attachment 2 has means to couple an implement to the implement attachment 2.

The axes 2*c* may need to be locked so that they do not drop out through the hole 1*e* but are properly supported by the holes 1*e*, i.e. one end of the axis is in the hole 1*e* of one adapter 1 and the other end of the axis is in the hole of the adapter 1 in the opposite wall 2*a* of the implement attachment. The locking may be performed e.g. by putting a perforated shoulder (not shown) into a groove of the axis and fastening the perforated shoulder by screwing a screw (not shown) to a threaded hole 1*g* of the shaft 1*a*. However, the locking may also be performed by some other appropriate method to prevent the axes falling out from the implement attachment 2.

In some embodiments the implement attachment 2 is not needed but the implement 4 may comprise the elements of the implement attachment 2 for receiving the adapter 1 and the axes 2*c*.

In the embodiment of FIGS. 3*a*-3*d* the implement attachment 2 has four holes for adapters 1 so that two axes 2*c* can be coupled to the working arm 3. Therefore, four adapters 1 need to be installed to the implement attachment 2. This can be performed e.g. in the following way. The shaft 1*a* of the adapter 1 is installed to the hole of the side wall 2*a* of the implement attachment. The rotation angle of the adapters 1 are set so that the distance d2 between the axes 2*c* correspond with the distance of the means in the working arm 3 for receiving the axes 2*c*. The working arm 3 may comprise, for example, a boom 3*a* and one or more hydraulic cylinders 3*b*, or some other kinds of structures. When the correct position has been found the adapters 1 can be tightened to the implement attachment 2 by screwing the nuts 1*d* to the threading to the shaft 1*a*. In some embodiments the rotational positions of the adapters 1 with respect to each other may be adjusted so that the distance d2 between a centre of the acentric holes 1*d* of the adapters 1 corresponds with the distance of a centre of two axes 2*a* of the implement attachment 2.

The adapters can be secured to prevent rotational movements of the adapters 1 in the holes by inserting e.g. one or more bolts 5 (illustrated in FIGS. 5*a* and 5*b*) on the locations of the movement restricting formations 1*c* of the adapters 1. Due to the construction of the movement restricting formations the location of the one or more bolts need not be very accurate but it should be sufficient to be within the area of the movement restricting formation.

If the distance d2 need to be changed e.g. when the implement attachment 2 should be connected to a different work arm 3, the fixing of one or more of the adapters 1 could be released or at least partly released e.g. by unscrewing the nut(s) 1*d* so that one or more of the adapters could be rotated to a different angular position to decrease or increase the distance d2. After the correct position has been found, the adapters 1 can be tightened e.g. by screwing the nuts 1*d*.

In some situations it may be necessary to adjust the position of the acentric holes 1*e* with respect to the work arm 3 and/or the implement attachment 2. In other words, the centres of the acentric holes form a kind of a straight line and the direction of this line with respect to the bottom of the implement attachment 2 can be changed by rotating the adapters 1 in the holes 2*b*. By this kind of rotation the difference of the distances of the centres of the holes 1*e* of the adapters 1 from e.g. the bottom of the implement attachment 2 may be changed. This difference of distances is illustrated with the reference e in FIG. 3*d*. It should be noted that although the difference e of the distances were changed, the mutual distance d2 of the holes 1*e* of the adapters 1 need not be changed. Therefore, this arrangement enables the adjustment of the implement attachment 2 with respect to the work arm 3 without affecting the distance between the axes (the holes 1*e*).

Figure 6:
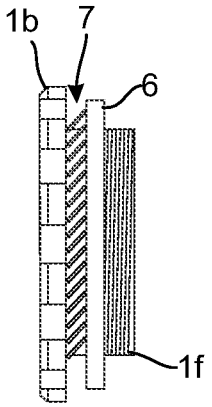
FIG. 6 depicts an example of using a bush ring and a locking ring with the adapter.

In some embodiments the implement attachment 2 can also be adapted to work arms 3 having axes of different lengths. This may be performed e.g. by inserting one, two or more bush rings 6 (FIG. 6) on the shaft of the adapter 1 or by amending the distance between the walls 2*a* of the implement attachment 2.

In some embodiments mutual adhesion between the adapter 1 and the implement attachment 2 may be increased by adding a locking ring 7 on the shaft 2*a* of the adapter so that the locking ring when the adapter is tightened forms a kind of spring force on the wall of the implement attachment 2. Thus, friction between the wall of the implement attachment 2 and the surface of the base element 1*b* may be increased.

In many embodiments of the adapter 1 of the present invention the friction between the wall of the implement attachment and the surface of the base element (1*b*) may be so strong that no welding of parts of the adapter 1 to the implement attachment 2 is required.

Figure 5A:
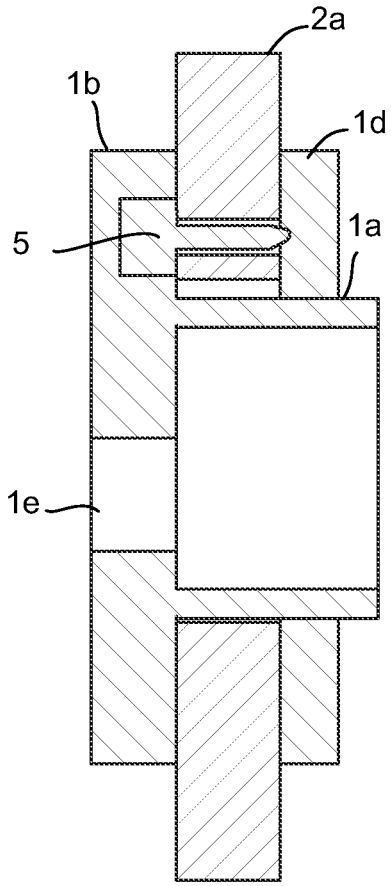
FIG. 5*a* depicts some details of the adapter installation to the implement attachment according to an example embodiment as a simplified cross sectional view.

FIG. 5*a* depicts some details of the adapter installation to the implement attachment as a simplified cross sectional view. It can be seen that the shaft 1*a* of the adapter goes through the hole in the side wall of the implement attachment and that the base element 1*b* as well as the nut 1*d* are located against the wall 2*a* on the opposite sides of the walls. In this example also the bolt 5 which is intended to restrict the rotational movement of the adapter 1 goes though the wall 2*a*. The tip of the bolt can be sharpened so that it may partly protrude through the surface of the nut 1*d*, of the nut 1*d* may have e.g. notches for receiving the tip of the bolt. This may further increase the rotation restricting effect of the bolt.

Figure 5B:
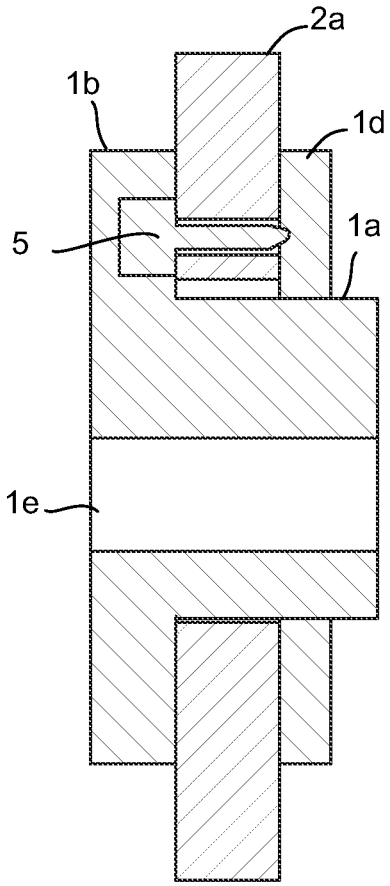
FIG. 5*b* depicts some details of the adapter installation to the implement attachment according to another example embodiment as a simplified cross sectional view.

FIG. 5*b* depicts some details of the adapter installation to the implement attachment according to another example embodiment as a simplified cross sectional view. In this embodiment the hole 1*e* has a substantially constant diameter within the shaft 1*a*.

In some embodiment of the present invention the thickness of the wall 2*a* of the implement attachment 2 may be different in different embodiments because the nut 1*d* can be screwed on the threading of the shaft 1*a* to an appropriate position so that the nut tightens the adapter 1. Therefore, the same adapter 1 may be used with many different kinds of implement attachments 2 provided that the length of the shaft 1*a* and the threading on the shaft is sufficient for locating the wall 2*a* between the base element 1*b* and the nut 1*d*.

In the examples presented above (and illustrated in more details in FIGS. 1*a*-1*f*) the base element 1*b* is fixed with the shaft 1*a* or they may have been formed as one piece e.g. by using a mold and melted steel, or by cutting from a steel bar an appropriate piece and turn-milling the piece to an appropriate form. In some other embodiments the base element 1*b* may be separate from the shaft 1*a*, wherein the base element 1*b* may have notches or protrusions to fit with protrusions or notches of a shaft so that the base element 1*b* can be attached with the shaft. In some embodiments such a separate base element can be welded to the surface of the wall 2*a* and the shaft 1*a* of the adapter can then be fitted to the base element at an appropriate position and the final fixing may be performed by screwing the nut 1*d* to the threading of the shaft 1*a*.

Figure 2A:
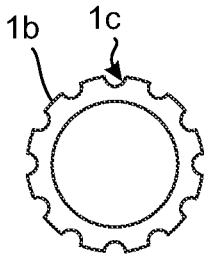
FIGS. 2*a*-2*k* depict some examples of the adapter according to another example embodiment of the present invention.
Figure 2B:
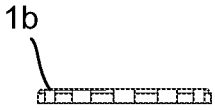
Figure 2C:
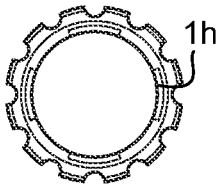
Figure 2D:
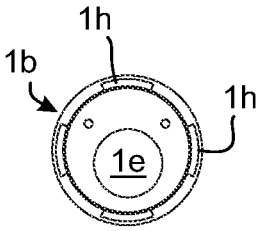
Figure 2E:
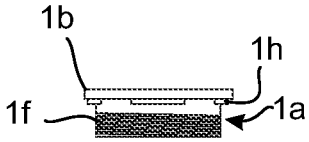
Figure 2F:
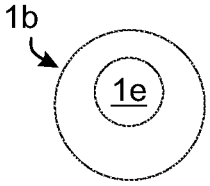
Figure 2G:
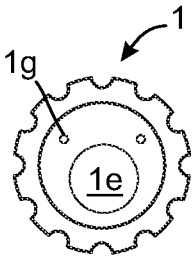
Figure 2H:
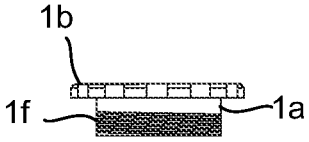
Figure 2I:
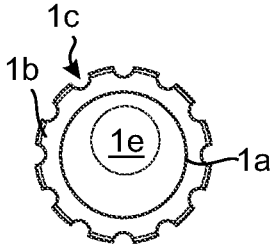
Figure 2J:
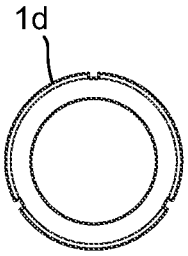
Figure 2K:
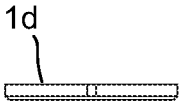

FIGS. 2*a*-2*k* illustrate an example of the adapter 1 in which the base element 1*b* is separate from the shaft 1*a*. In this example embodiment the base element 1*b* comprises the movement restriction formations 1*c* and e.g. notches 1*i* as is illustrated in FIGS. 2*a* (top view), 2*b* (side view), and 2*c* (bottom view). The shaft 1*a* of this example embodiment is illustrated in FIGS. 2*d* (bottom view), 2*e* (side view), and 2*f* (top view). The shaft 1*a* comprises e.g. notches 1*h* which are adapted to receive the protrusions 1*i* of the base element 1*b* when the shaft and the base element are fitted to the implement attachment 2. In this example embodiment there are four notches 1*h* and four protrusions 1*i* so that the shaft 1*a* can have four different rotational positions with respect to the base element 1*b*, but it is obvious that the number of notches 1*h* and protrusions 1*i* may differ from four in different embodiments. FIG. 2*g* illustrates as a bottom view the situation in which the shaft 1*a* and the base element 1*b* have been coupled together, FIG. 2*h* illustrates the situation in which the shaft 1*a* and the base element 1*b* have been coupled together as a side view, and FIG. 2*i* illustrates the situation in which the shaft 1*a* and the base element 1*b* have been coupled together as a top view. FIG. 2*j* illustrates a nut as a top view and FIG. 2*k* illustrates the nut 1*d* as a side view. The nut 1*d* in this example embodiment may be similar to or different from the nut 1*d* of the example embodiment of FIGS. 1*a*-1*f*.

The adapter 1 according to the invention can be used with many kinds of working machines to enable the usage of a broader scope of implements without the need to manufacture the implement specifically to that particular working machine. Some non-limiting examples of such working machines are excavators, diggers, cranes etc.

The invention claimed is:

1. An adapter for mounting an implement to a working arm of a working machine, the adapter comprising:
an acentric hole for an implement attachment;
a base element having one or more movement restricting formations;
a shaft having a threading;
a nut for tightening the adapter to the implement attachment;
a bolt having a tip at one end and a base in another end; and
a hole in the base element for receiving the bolt;
wherein a diameter of the base of the bolt is larger than a diameter of the hole, and the tip of the bolt is configured to extend through the hole.

2. An adapter according to claim 1, wherein the one or more movement restricting formations comprise one or more of the following:
one or more notches at an outer circumference of the base element;
one or more protrusions on a surface of the base element;
one or more holes through the base element.

3. An adapter according to claim 1, wherein the nut comprises one or more notches configured for receiving the tip of the bolt.

4. An adapter according to claim 1, wherein the adapter further comprises at least one bush ring on the shaft.

5. An adapter according to claim 1, wherein the adapter further comprises at least one locking ring on the shaft.

6. An adapter according to claim 1, wherein the base element is adapted to be welded on a wall of the implement attachment.

7. An adapter according to claim 1, wherein the diameter of the hole of the shaft is constant.

8. An implement attachment comprising an adapter, the adapter comprising:
an acentric hole for an implement attachment;
a base element having one or more movement restricting formations;
a shaft having a threading; and
a nut for tightening the adapter to the implement attachment;
a bolt having a tip at one end and a base in another end; and
a hole in the base element for receiving the bolt;
wherein a diameter of the base of the bolt is larger than a diameter of the hole, and the tip of the bolt is configured to extend through the hole.

9. A working machine comprising a working arm and an adapter, the adapter comprising:
an acentric hole for an implement attachment;
a base element having one or more movement restricting formations;
a shaft having a threading; and
a nut for tightening the adapter to the implement attachment
a bolt having a tip at one end and a base in the other end; and
a hole in the base element for receiving the bolt;
wherein a diameter of the base of the bolt is larger than a diameter of the hole, and the tip of the bolt is configured to extend through the hole.

10. An adapter for mounting an implement to a working arm of a working machine, the adapter comprising:
a base element having one or more movement restricting formations;
an acentric hole in the base element for an axis of an implement attachment;
a shaft having a hole for the axis and a threading at an outer circumference of the shaft;
a nut for tightening the adapter to the implement attachment;
a bolt having a tip at one end and a base in the other end; and
a hole in the base element for receiving the bolt;
wherein a diameter of the base of the bolt is larger than a diameter of the hole, and the tip of the bolt is configured to extend through the hole;
further wherein the base element and the shaft are separate parts.

11. An adapter according to claim 10, wherein the base element comprises protrusions on one surface, and the shaft comprises notches configured to receive the protrusions of the base element.

* * * * *